US006882926B2

(12) United States Patent
Thoss et al.

(10) Patent No.: US 6,882,926 B2
(45) Date of Patent: Apr. 19, 2005

(54) METHOD AND DEVICE FOR CONTROLLING AN INTERNAL COMBUSTION ENGINE

(75) Inventors: Dieter Thoss, Schwieberdingen (DE); Athanasios Hailas, Esslingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/362,256

(22) PCT Filed: Jun. 15, 2002

(86) PCT No.: PCT/DE02/02191

§ 371 (c)(1),
(2), (4) Date: Aug. 1, 2003

(87) PCT Pub. No.: WO03/001043

PCT Pub. Date: Jan. 3, 2003

(65) Prior Publication Data

US 2004/0015286 A1 Jan. 22, 2004

(30) Foreign Application Priority Data

Jun. 23, 2001 (DE) ..... 101 30 378

(51) Int. Cl.[7] ..... F02D 45/00
(52) U.S. Cl. ..... 701/102; 701/110; 123/406.65
(58) Field of Search ..... 701/102, 110, 701/114, 115; 123/478, 486, 406.65, 406.58

(56) References Cited

U.S. PATENT DOCUMENTS

| | | | | | |
|---|---|---|---|---|---|
| 4,413,602 | A | * | 11/1983 | Inoue et al. | 123/486 |
| 4,472,776 | A | * | 9/1984 | Deleris et al. | 701/115 |
| 4,726,338 | A | * | 2/1988 | Decker et al. | 123/476 |
| 4,744,343 | A | * | 5/1988 | Bisenius et al. | 123/476 |
| 4,766,865 | A | | 8/1988 | Haertel | 123/476 |
| 4,791,569 | A | | 12/1988 | Suzuki | 701/114 |
| 4,962,743 | A | * | 10/1990 | Perr et al. | 123/496 |
| 5,609,545 | A | * | 3/1997 | Sola et al. | 477/78 |
| 5,829,412 | A | | 11/1998 | Klatt et al. | 123/479 |
| 6,286,365 | B1 | * | 9/2001 | Lang et al. | 73/116 |

FOREIGN PATENT DOCUMENTS

| | | | | |
|---|---|---|---|---|
| DE | 42 10 559 | | 10/1993 | |
| DE | 198 54 304 | | 5/2000 | |
| EP | 0 486 088 | | 5/1992 | |
| JP | 2-308952 A | * | 12/1990 | F02D/45/00 |

* cited by examiner

*Primary Examiner*—Hieu T. Vo
(74) *Attorney, Agent, or Firm*—Kenyon & Kenyon

(57) ABSTRACT

A method and a device for controlling an internal combustion engine using at least two control units. One engine rotation is divided into a predefined number of subsegments of equal length. One or a plurality of subsegments are able to be combined in each case into one segment. Control data are calculated in all subsegments. Each control unit outputs the control data once per segment.

8 Claims, 2 Drawing Sheets

METHOD AND DEVICE FOR CONTROLLING AN INTERNAL COMBUSTION ENGINE

FIELD OF THE INVENTION

The present invention is directed to a method and a device for controlling an internal combustion engine using at least two control units.

BACKGROUND INFORMATION

A method and a device for controlling an internal combustion engine using at least two control units are known from German Patent No. 198 54 304. The system shown therein relates to an internal combustion engine having eight cylinders, four cylinders in each case being assigned to one bank and being acted upon by control signals from a control device, especially to control the fuel metering.

In such a system, a fuel injection and, thus, a firing, occur following a rotation of the crankshaft by 90°. As a rule, the injections or firings cannot always be evenly divided between the two control devices. For instance, it can be provided that a first control device controls the injection into the first, fourth, sixth and seventh cylinder, and a second control device controls the injection into the second, third, fifth and eighth cylinder.

In order to provide cost-effective control devices, it should be possible to use the control devices not only for internal combustion engines having four cylinders, but also for internal combustion engines having eight cylinders. This means that two control devices, which are normally used for four-cylinder internal combustion engines, are intended to be utilized in an eight-cylinder internal combustion engine. The control devices should differ from each other as little as possible, i.e., the same hardware of the control device and also the same software of the control device should be able to be used, regardless of whether four or eight cylinders are used.

Slight differences in the two control devices should merely be required in the area of the control data. The normal application data should be modified only slightly, if at all.

SUMMARY OF THE INVENTION

According to the present invention, it is provided that, in a method and a device for controlling a vehicle using at least two control devices, an engine rotation is divided into a predefined number of subsegments having equal length. One or a plurality of subsegments are able to be combined into one segment in each case. Control data are preferably calculated once in all sub-segments. The control unit outputs the control data once per segment. The present invention provides that an engine rotation be divided into two types of segments, which are referred to as segments or subsegments. In this context, the actions that in conventional control units are in each case performed in a segment, are carried out first of all in a sub-segment, and secondly in a segment. In at least one segment, two subsegments are preferably combined into a segment.

Preferably it is provided that the control data are calculated precisely once in each subsegment, and are output precisely once in each segment.

A particularly simple implementation results if, in a first control unit, the control data is output in each segment, in each case in the first subsegment, and/or if, in a second control unit, the control data is output in a first segment, in each case in a predefinable subsegment, and/or, in the remaining segments it is in each case output in the first subsegment. This means that the control data, as a rule, are output in the first subsegment of each segment. Only one segment of a control unit constitutes an exception. Here, the output of the control data may occur in any desired subsegment.

DETAILED DESCRIPTION

Figure 1:
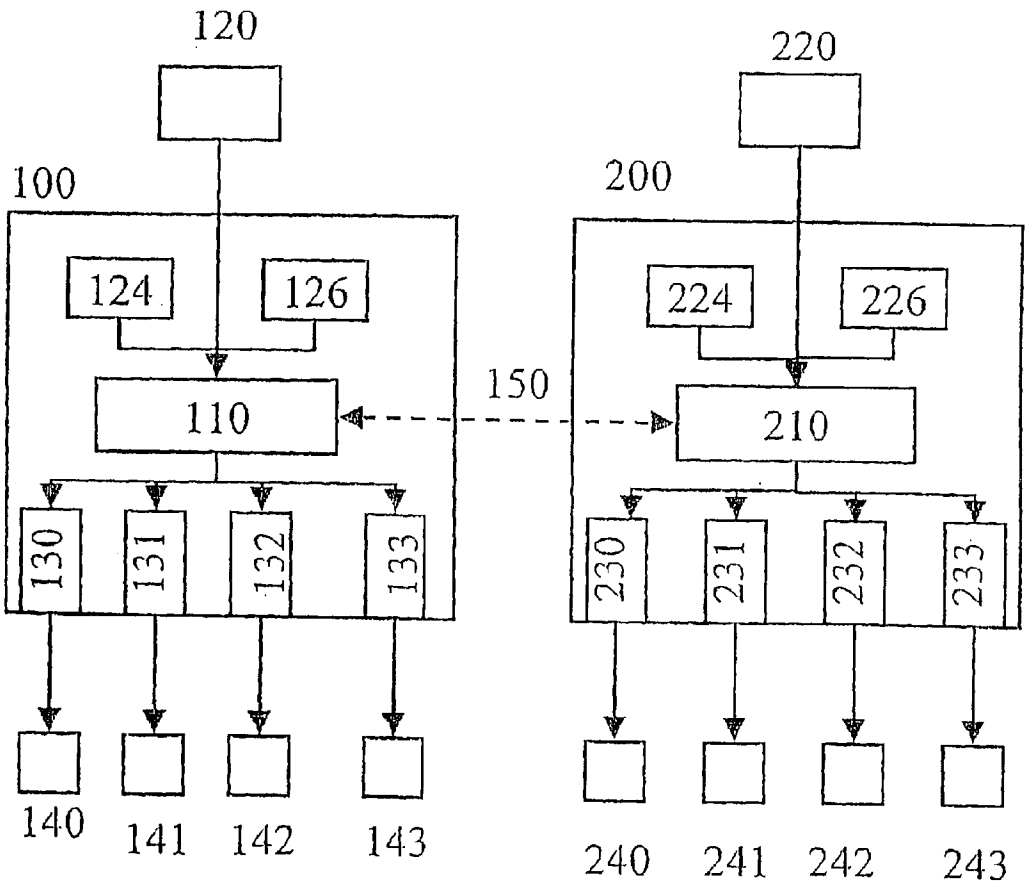
FIG. 1 is a block diagram of two control devices.

FIG. 1 shows a device for controlling a vehicle using two control units. A first control unit is denoted by 100. It essentially includes a computing device 110, which is connected to a data storage 124 and a program storage 126. Moreover, control unit 100 receives signals from sensors 120. Computing device 110 applies control signals to output stages 130, 131, 132 and 133. The output stages in turn apply control signals to control elements 140, 141, 142 and 143. The control elements are preferably solenoid valves and/or piezoelectric actuators by which the fuel metering into an internal combustion engine is able to be controlled.

Furthermore, a second control unit 200 is provided, which essentially includes the same structural components. The second control unit basically includes a computing device 210, which is connected to a data storage 224 and a program storage 226. Moreover, control unit 200 receives signals from sensors 220. Computing device 210 applies control signals to output stages 230, 231, 232 and 233. The output stages, in turn, apply control signals to control elements 240, 241, 242 and 243.

The first and the second control units exchange data via a line 150. In this case, a bus system is preferably used, in particular, a so-called CAN-bus. Via this bus system, data may also be exchanged with other systems (not shown here).

The specific embodiment shown is an internal combustion engine having eight cylinders. The procedure according to the present invention is not limited to the number of control elements, but may also be used in internal combustion engines having different numbers of control elements. For instance, it is possible to proceed in a corresponding manner in the case of a twelve-cylinder internal combustion engine. In this case, three control units having four control elements to be controlled, or two control units each having six control elements to be controlled, are to be provided. Alternatively, it may also be provided that each control unit controls merely two or three control elements.

Program storage 126 stores the program that computing device 110 uses to calculate the signals for controlling output stages 130 through 133. For this purpose, the computing device uses data stored in data storage 124 and also the signals acquired from sensors 120.

On the basis of signals characterizing the operating state of the internal combustion engine, of the vehicle or the environmental conditions, and with the aid of the data stored in data storage 124, computing device 110 calculates control data for controlling various controlling elements, using the program stored in program storage 126. In the exemplary embodiment shown, control signals for injection valves 140 through 143 are calculated.

These control signals are preferably angular positions at which the current flow through the solenoid valve is to begin or end. For each solenoid valve, these angular sizes are preferably stored in a storage element.

This means that a plurality of storage elements, in which the control data are stored, are provided for all injection valves. Preferably, one storage element each is provided for the start of the injection and for the end of the injection. If a plurality of partial injections is intended, at least two storage elements each are provided for each partial injection.

Normally, it is provided that one engine rotation be divided into a plurality of subsegments. Preferably, each injection is assigned at least one subsegment. This means that the number of subsegments corresponds to a whole-number multiple of the number of cylinders. If exactly one subsegment is assigned to each cylinder, the calculation of the control data, their output and the controlling of the control element occur precisely once per subsegment. In an internal combustion engine having four cylinders, one segment corresponds to 180°.

The first control unit 100 or the second control unit 200 is able to control one four-cylinder internal combustion engine in each case. If an eight-cylinder internal combustion engine is to be controlled, two identical control units are preferably used. These then exchange appropriate signals via line 150.

The present invention provides that the two control devices are suited not only for four-cylinder internal combustion engines but also for those cases where two control devices are utilized for eight-cylinder internal combustion engines, without this requiring fundamental modifications. In particular when using it in an eight-cylinder internal combustion engine versus a four-cylinder internal combustion engine, the data in program storage 126 are not to be modified. It is merely provided that only very few data of data storage 124 are to be modified, thereby allowing a downward-compatibility for the normal, conventional four-cylinder control device.

If the injections are always calculated alternately by the first or the second control device, the current software may be used without any problems. Problems only arise when an arbitrary ignition sequence of the cylinders is desired. Until now, this can only be accomplished by a complicated interrupt scheme and certain tricks in the area of control.

The procedure according to the present invention makes this possible without special effort. For instance, only very few application data need to be modified. According to the present invention, each segment is to be divided into various subsegments, or various subsegments are to be combined into segments.

According to the present invention, the calculation of the control data is carried out in each subsegment. This ensures that the calculations are always implemented at fixed intervals. Moreover, it is provided that one injection occurs in each segment, i.e., the control data are calculated once or several times in each segment. The output of the control data or the actuation of the control elements is implemented only once per segment, thereby ensuring that the data outputs and monitoring routines, which are carried out once per segment, continue to be implemented once per segment.

According to the present invention it is provided that all subsegments have an equal length and that the number of subsegments corresponds to the number of cylinders, whose number is eight in the exemplary embodiment shown. In this context, the length of a segment corresponds to the number of subsegments multiplied by the length of the subsegment. The number of subsegments per segment is arbitrary. An appropriate division of the segments into subsegments, or the appropriate combination of the subsegments into segments, allows nearly any desired ignition sequence.

Preferably, it is provided that all subsegments be of equal length. Furthermore, since the calculation of the control data is carried out in each subsegment, it is ensured that all calculations are regularly implemented at fixed angular spacings. The calculations are implemented once per subsegment.

If the control device is used for a four-cylinder internal combustion engine, the number of the subsegments is selected to match the number of segments, i.e., one subsegment corresponds to one segment.

Basically, it is possible to proceed in a similar manner with other numbers of cylinders as well. For instance, when working with twelve-cylinder internal combustion engines, twelve subsegments may be provided, and three control devices may assume the control. A control device having three output stages is used for three-cylinder internal combustion engines; in the case of six cylinders, two control devices may then be correspondingly utilized, which include three segments and six subsegments.

Figure 2:
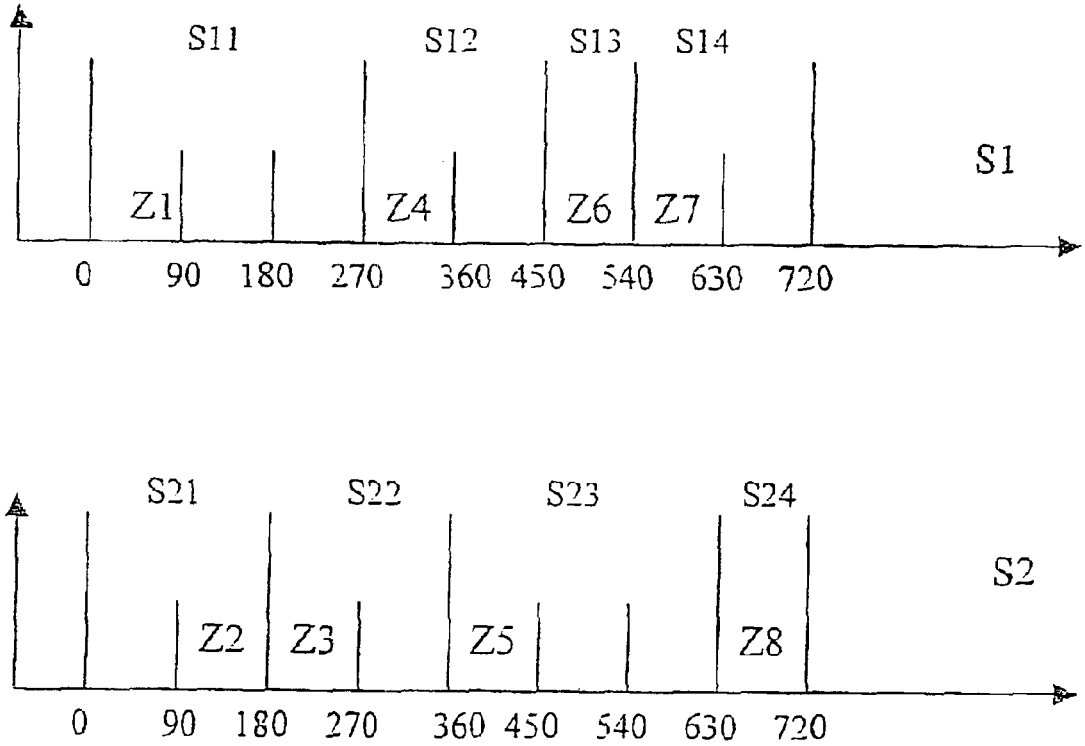
FIG. 2 shows different signals plotted over time.

FIG. 2 illustrates the division of the subsegments for first control device S1 and second control device S2 by way of example. Long perpendicular lines mark the segments, which are denoted for the first cylinder by reference numerals S11, S12, S13 and S14, and which are denoted for the second cylinder by reference numerals S21, S22, S23 and S24. First segment S11 of the first cylinder is divided into three subsegments, which are marked by small perpendicular lines. Second segment S12 is divided into two subsegments, third segment S13 into one subsegment, and fourth segment S14 is divided into two subsegments. First segment S21 of the second cylinder is divided into two subsegments. Second segment S22 is divided into two subsegments, third segment S23 into three subsegments, and fourth segment S24 into one subsegment.

In the first control unit, the calculation and injection are carried out in the respective first subsegment of each segment. In second control device S2, the calculation and the output are implemented in the first segment in predefined subsegments—in the example shown, it is the second subsegment—and in the remaining segments it is in each case in the first subsegment.

Within the framework of the present application, the total number and the number of subsegments per segment have to be stipulated for the control units and likewise the subsegment in which the second control unit outputs the control data in the first segment. When used as a conventional control unit for an internal combustion engine having four cylinders, the total number of subsegments is set to four, and the number of subsegments per segment is set to one.

What is claimed is:

1. A device for controlling an internal combustion engine comprising:

means for subdividing one engine rotation into a predefined number of subsegments of equal length;

means for combining in each case at least one of the subsegments into one segment; and at least two control units calculating control data in all of the subsegments, each of the control units outputting the control data once per segment;

wherein, in a first of the control units, the control data are output in each segment, in each case in a first of the subsegments.

2. The device according to claim 1, wherein the control data in remaining segments are in each case output in the first subsegment.

3. A device for controlling an internal combustion engine comprising:

means for subdividing one engine rotation into a predefined number of subsegments of equal length;

means for combining in each case at least one of the subsegments into one segment; and at least two control units calculating control data in all of the subsegments, each of the control units outputting the control data once per segment;

wherein, in a second of the control units, the control data are output in a first segment, in each case in a predefined one of the subsegments.

4. A device for controlling an internal combustion engine comprising:

means for subdividing one engine rotation into a predefined number of subsegments of equal length;

means for combining in each case at least one of the subsegments into one segment; and at least two control units calculating control data in all of the subsegments, each of the control units outputting the control data once per segment;

wherein the control data are calculated once in each of the subsegments.

5. A method for controlling an internal combustion engine, comprising:

dividing one engine rotation into a predefined number of subsegments of equal length;

combining in each case at least one of the subsegments into one segment;

calculating control data in all of the subsegments; and outputting, from each of at least two control units, the control data once per segment;

wherein the control data are calculated once in each of the subsegments.

6. A method for controlling an internal combustion engine, comprising:

dividing one engine rotation into a predefined number of subsegments of equal length;

combining in each case at least one of the subsegments into one segment;

calculating control data in all of the subsegments; and outputting, from each of at least two control units, the control data once per segment;

wherein, in a first of the control units, the control data are output in each segment, in each case in a first of the subsegments.

7. The method according to claim 6, wherein the control data in remaining segments are in each case output in the first subsegment.

8. A method for controlling an internal combustion engine, comprising:

dividing one engine rotation into a predefined number of subsegments of equal length;

combining in each case at least one of the subsegments into one segment;

calculating control data in all of the subsegments; and outputting, from each of at least two control units, the control data once per segment;

wherein, in a second of the control units, the control data are output in a first segment, in each case in a predefined one of the subsegments.

* * * * *